US005458795A

United States Patent [19]

Lawate

[11] Patent Number: 5,458,795

[45] Date of Patent: Oct. 17, 1995

[54] OILS THICKENED WITH ESTOLIDES OF HYDROXY-CONTAINING TRIGLYCERIDES

[75] Inventor: Saurabh S. Lawate, Concord, Ohio

[73] Assignee: The Lubrizol Corporation, Wickliffe, Ohio

[21] Appl. No.: 188,264

[22] Filed: Jan. 28, 1994

[51] Int. Cl.[6] ..... C10M 129/72

[52] U.S. Cl. ..... 252/56 R; 252/56 S

[58] Field of Search ..... 252/56 R, 56 S

[56] References Cited

U.S. PATENT DOCUMENTS

| | | | |
|---|---|---|---|
| 844,426 | 2/1907 | Twitchell . | |
| 2,049,072 | 7/1936 | Mikeska et al. | 87/9 |
| 2,156,737 | 5/1939 | Priester | 260/413 |
| 2,652,410 | 9/1953 | Cunningham et al. | 260/404.5 |
| 2,652,411 | 9/1953 | Teeter et al. | 260/405 |
| 2,877,181 | 3/1959 | Dilworth et al. | 252/40.5 |
| 3,634,245 | 1/1972 | Meisters | 252/49.3 |
| 3,720,695 | 3/1973 | Meisters | 260/404.8 |
| 3,909,425 | 9/1975 | Crawford et al. | 252/32.7 |
| 4,067,817 | 1/1978 | Sturwold | 252/49.3 |
| 4,108,785 | 8/1978 | Sturwold | 252/56 R |
| 4,582,715 | 4/1986 | Volpenhein | 426/601 |
| 4,769,178 | 9/1988 | Kenmochi et al. | 252/56 |
| 4,885,104 | 12/1989 | Sturwold | 252/56 S |
| 4,978,465 | 12/1990 | Sturwold | 252/56 S |
| 5,037,564 | 8/1991 | Nishizaki et al. | 252/22 |
| 5,145,593 | 9/1992 | Takashima | 252/56 |
| 5,151,205 | 9/1992 | Culpon, Jr. | 252/51.5 |
| 5,282,989 | 2/1994 | Ericksen et al. | 252/56 R |
| 5,298,177 | 3/1994 | Stoffa | 252/56 R |

*Primary Examiner*—Jacqueline V. Howard
*Attorney, Agent, or Firm*—James L. Cordek; Frederick D. Hunter; Joseph P. Fischer

[57] ABSTRACT

A thickened composition is disclosed which comprises (A) at least one triglyceride estolide of the formula

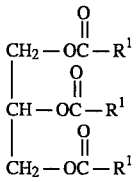

wherein $R^1$ is an aliphatic group or an aliphatic group containing an ester moiety $R^2COO$— with the proviso that at least one $R^1$ is an aliphatic group containing the ester moiety, and contains from about 5 to about 23 carbon atoms, and $R^2$ is a hydrocarbyl group containing from 1 to 100 carbon atoms and (B) at least one oil comprising (1) a synthetic ester base oil (2) a mineral oil, or (3) a polyalphaolefin.

18 Claims, No Drawings

OILS THICKENED WITH ESTOLIDES OF HYDROXY-CONTAINING TRIGLYCERIDES

FIELD OF THE INVENTION

The present invention relates to the thickening of oils by dissolving therein an estolide of a hydroxy-containing triglyceride. Thickened oils find utility in high temperature applications.

BACKGROUND OF THE INVENTION

Successful use of oils in industrial applications and also as a fuel additive when mixed with normally liquid fuels, is contingent upon increasing or thickening the viscosity of the oils. In many industrial applications the oils are too thin to be of value.

U.S. Pat. No. 844,426 (Twitchell, Feb. 19, 1907) relates to a process for manufacturing certain organic products. One of the reactants contains an alcoholic hydroxyl, of which castor oil is cited, and the other reactant is a fatty acid such as stearic and oleic acids. The reaction takes place in the presence of a catalyst described as containing a sulfa fatty acid group.

U.S. Pat. No. 2,156,737 (Priester, May 2, 1939) relates to the preparation or production of unsaturated fatty acids of the type containing two double bonds and to the preparation of an intermediate product from which said unsaturated fatty acids may be derived.

More particularly stated, this reference relates to a process for the preparation of 9, 11-octadecadiene 1-acid from ricinoleic acid. The ricinoleic acid is both pure ricinoleic acid or ricinoleic acid obtained from castor oil of which the latter being obtained by the splitting up of castor oil.

U.S. Pat. No. 2,049,072 (Mikeska et al, Jul. 28, 1936) relates to the preparation of lubricants by blending with a mineral oil the product obtained by esterification of hydroxy groups in natural or synthetic fatty acids or glycerides, with special reference to castor oil, with or without subsequent stabilizations of said esterified product as by hydrogenation.

U.S. Pat. No. 2,652,410 (Cunningham et al, Sep. 15, 1953) relates to methods for reacting alpha-hydroxy acids and/or estolides with polyhydric alcohols. More particularly, this reference relates to methods for esterifying and dehydroxylating alpha-hydroxy acids and/or estolides such as are obtained by the controlled oxidation of paraffin wax.

U.S. Pat. No. 2,877,181 (Dilworth et al, Mar. 10, 1959) relates to anhydrous calcium fatty acid greases. More particularly, this reference discloses an additive that stabilizes anhydrous calcium fatty acid greases. This additive is an estolide and the estolides which act as stabilizers are intermolecular esters and polyesters of $C_{10}$ to $C_{24}$ hydroxy fatty acids having the general formula

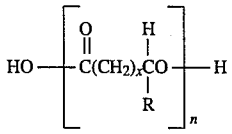

wherein R is an aliphatic hydrocarbon radical containing 1 to 21 carbon atoms, x is an integer having a value to 1 to 21 and n is an integer having a value of 2 to about 12.

U.S. Pat. No. 4,582,715 (Volpenhein, Apr.15, 1986) relates to alpha acrylated glycerides of the formula:

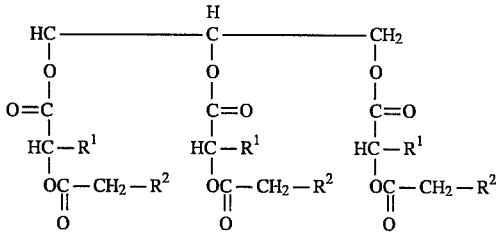

wherein each $R^1$ is a $C_{10}$–$C_{14}$ alkyl group and wherein each $R^2$ is a $C_{14}$–$C_{16}$ aliphatic group.

SUMMARY OF THE INVENTION

A composition is disclosed which comprises (A) at least one triglyceride estolide of the formula

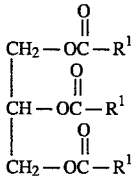

wherein $R^1$ is an aliphatic group or an aliphatic group containing an ester moiety $R^2COO$— with the proviso that at least one $R^1$ is an aliphatic group containing the ester moiety, and contains from about 5 to about 23 carbon atoms, and $R^2$ is a hydrocarbyl group containing from 1 to 100 carbon atoms and (B) at least one oil comprising (1) a synthetic ester base oil, (2) a mineral oil, or (3) a polyalphaolefin.

DETAILED DESCRIPTION OF THE INVENTION (A) The Triglyceride Estolide

An estolide is the product formed by the esterification reaction of a hydroxy-containing fatty acid and a carboxylic acid.

The esterification to form the estolide occurs at a temperature of from ambient up to the decomposition temperature of any reactant or product. Usually the upper temperature limit is not more than 150° C. and preferably not more than 120° C. To shift the equilibrium to the right when forming an estolide, it is necessary to use either a large excess of carboxylic acid, or else remove water as it is formed. In either case, excess carboxylic acid or formed water can be removed by distillation.

As an example, under proper conditions the —OH from one ricinoleic acid molecule can react with the —COOH of another ricinoleic acid molecule to give an estolide:

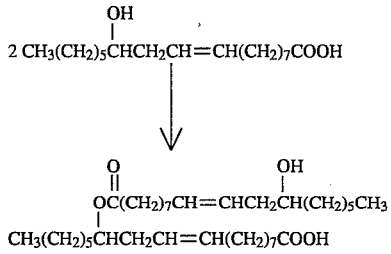

This estolide would continue to crosslink or react linearly at the unreacted —OH and —COOH sites to form a polyestolide.

In this invention, component (A) is a triglyceride estolide of the formula

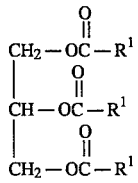

wherein $R^1$ is an aliphatic group containing from 10 to 20 carbon atoms or an aliphatic group containing an ester moiety $R^2COO$— with the proviso that at least one $R^1$ is an aliphatic group containing the ester moiety, and contains from about 5 to about 23 carbon atoms, and $R^2$ is a hydrocarbyl group containing from 1 to 100 carbon atoms.

The aliphatic group $R^1$ is alkyl such as pentyl, heptyl, nonyl, undecyl, tridecyl, heptadecyl; alkenyl containing a single bond such as heptenyl, nonenyl, undecenyl, tridecenyl, heptadecenyl, nonadecenyl, heneicosenyl; alkenyl containing 2 or 3 double bonds such as 8,11-heptadecadienyl and 8,11,14-heptadecatrienyl. All isomers of these are included, but straight chain groups are preferred.

At least one of the $R^1$ groups contains the ester moiety $R^2COO$—. The residue of this $R^1$ group (the $R^1$ as described above less the hydrogen and also less the $R^2COO$—) is still defined as an aliphatic group and as such is defined by the parameters of the aliphatic groups above. An example of an $R^1$ containing the ester moiety is

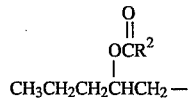

Removing the $R^2COO$— from this structure gives

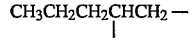

as a residue which is defined as an aliphatic group.

The hydrocarbyl group $R^2$ includes the following:

(1) Aliphatic hydrocarbon groups; that is, alkyl groups such as heptyl, nonyl, undecyl, tridecyl, heptadecyl; alkenyl groups containing a single double bond such as heptenyl, nonenyl, undecenyl, tridecenyl, isostearyl, heptadecenyl, heneicosenyl; alkenyl groups containing 2 or 3 double bonds such as 8,11-heptadecadienyl and 8,11,14-heptadecatrienyl. All isomers of these are included, but straight chain groups are preferred.

(2) Substituted aliphatic hydrocarbon groups; that is groups containing non-hydrocarbon substituents which, in the context of this invention, do not alter the predominantly hydrocarbon character of the group. Those skilled in the art will be aware of suitable substituents; examples are hydroxy, carbalkoxy, (especially lower carbalkoxy) and alkoxy (especially lower alkoxy), the term, "lower" denoting groups containing not more than 7 carbon atoms.

(3) Hetero groups; that is, groups which, while having predominantly aliphatic hydrocarbon character within the context of this invention, contain atoms other than carbon present in a chain or ring otherwise composed of aliphatic carbon atoms. Suitable hetero atoms will be apparent to those skilled in the art and include, for example, oxygen, nitrogen and sulfur.

At least one of the $R^1$ groups is an aliphatic group containing an ester moiety $R^2COO$—. In a preferred embodiment $R^1$ is

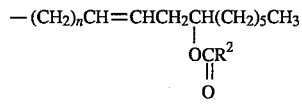

wherein n is from 5 to 13 and $R^2$ is an aliphatic group containing 1 to 23 carbon atoms, preferably from 4 to 18 carbon atoms.

The triglyceride estolide (A) is prepared by reacting a triglyceride that contains at least one —OH group with a carboxylic acid $R^2COOH$. At least 1 up to 3 —OH groups are present in the triglyceride. For each —OH group present, there is employed one mole of carboxylic acid.

Triglycerides containing —OH groups occur in nature as castor oil wherein n is 7 and contains three —OH groups and lesquerella oil wherein n is 9 and contains two —OH groups.

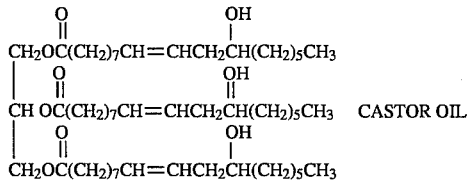

CASTOR OIL

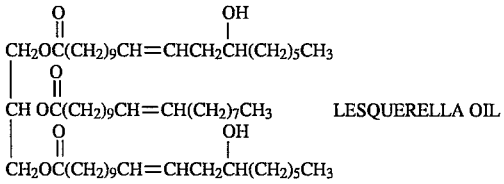

LESQUERELLA OIL

The chemical profiles of castor oil and lesquerella oil show triglycerides other than those of the structures outlined above. A triglyceride of ricinoleic acid is the predominate triglyceride of castor oil and is present at from 80–89% by weight. A triglyceride of 2 moles 14-hydroxy-11-eicosenoic acid and 1 mole 11-eicosenoic acid is the predominate triglyceride of lesquerella oil and is generally present is in lesquerella oil in an amount in excess of 50% by weight.

The carboxylic acid $R^2COOH$ reacted with the hydroxy-containing triglyceride contains from 2 to 24 carbon atoms (acetic acid to tetracosanoic acid) including isomers and unsaturation. Preferred carboxylic acids are the acids of butyric, caproic, caprylic, capric, lauric, myristic, palmitic, stearic, oleic, linoleic, and linolenic.

The esterification to make the triglyceride estolide occurs by reacting a carboxylic acid with the hydroxy containing triglyceride. One mole of carboxylic acid is employed for every —OH group present in the hydroxy-containing triglyceride.

The following examples are illustrative of the preparation of triglyceride estolides wherein the carboxylic acid is a monocarboxylic acid. Unless otherwise indicated, all parts and percentages are by weight. Solvents may or may not be employed. Optionally, the obtained estolides are refined and bleached.

EXAMPLE A-1

Added to a 1 liter, 4 neck flask are 200 parts (0.19 moles) of castor oil, 74.2 parts (0.57 moles) heptanoic acid, 300 ml xylene and 2.5 parts para-toluenesulfonic acid. The contents are heated to 150° C. with stirring during which time water is azeotroped off. Xylene is stripped off using a nitrogen sweep and later to 12 millimeters mercury. The contents are filtered to give the desired product.

EXAMPLE A-2

Lesquerella oil and heptanoic acid are reacted on a (1 —OH:1 —COOH) basis. The lesquerella oil, heptanoic acid, para-toluenesulfonic acid and xylene are added to a flask and the procedure of Example A-1 is essentially followed. The filtrate is the desired product.

EXAMPLE A-3

Lesquerella oil and isostearic acid are reacted on a (1 —OH:1 —COOH) basis. The lesquerella oil, isostearic acid, xylene and methanesulfonic acid are added to a flask and the procedure of Example A-1 is essentially followed. The filtrate is the desired product.

EXAMPLE A-4

Lesquerella oil and oleic acid are reacted on a (1 —OH:1 —COOH) basis. The lesquerella oil, oleic acid, xylene and methanesulfonic acid are added to a flask and the procedure of Example A-1 is essentially followed. The filtrate is the desired product.

Mono carboxylic acids are also formed by the hydrolysis of a triglyceride.

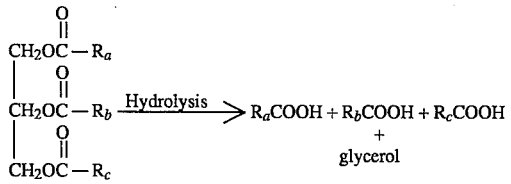

In the above reactions $R_a$, $R_b$ and $R_c$ are the same or different and contain from 1 to 23 carbon atoms.

The following example is directed to the preparation of a triglyceride estolide wherein the monocarboxylic acid is obtained from the hydrolysis of a triglyceride.

EXAMPLE A-5

Added to a 12 liter, 4 neck flask are 3129 parts Sunyl 87,3000 parts water and 1000 parts isopropyl alcohol. The mixture is heated to 60° C. and added is 100 parts of a 50% aqueous solution of sodium hydroxide. The sodium hydroxide solution is added in 50 millimeter portions. This addition is exothermic and cooling is required to keep the reaction under control. At the end of this addition, the contents are permitted to continue stirring for 6 hours. At 60° C. concentrated aqueous hydrochloric acid (37%) is slowly added until a pH of 2 is reached. At the end of this addition, the contents are permitted to stir for 30 more minutes. Stirring is halted and the contents separate into layers. The bottom (aqueous) portion is removed and discarded and the remainder of the contents is washed three times with 1000 parts hot water. After the third wash, the water layer is removed and discarded and the contents are stripped and filtered to give a monocarboxylic acid mixture containing 87% oleic acid.

In a separate flask are added lesquerella oil and the 87% oleic acid on a 1 —OH:1 —COOH basis, along with para-toluenesulfonic acid and xylene. The contents are heated to 150° C. with stirring while azeotroping off water. The contents are then stripped and filtered to give the desired product.

In another embodiment, acids other than aliphatic monocarboxylic acids may be reacted with the hydroxy containing triglyceride to form an estolide. These may be aliphatic dicarboxylic acids or aryl mono-, di- or tri- carboxylic acids. Aliphatic dicarboxylic acids are of the formula HOOCCH=CHCOOH or $HOOC(CH_2)_tCOOH$ wherein t is from zero up to 8. Envisioned within the formula HOOCCH=CHCOOH are maleic acid and fumaric acid. The aliphatic dicarboxylic acids of interest are: oxalic acid, malonic acid, succinic acid, glutaric acid, adipic acid, pimelic acid, suberic acid, azelaic acid and sebacic acid. One —COOH of component (B) is employed for each —OH group present within component (A).

The aryl carboxylic acids are of the formula $Ar(COOH)_x$ wherein Ar is a benzene or naphthalene nucleus and x is 1, 2 or 3. Aryl carboxylic acids having utility in this invention are benzoic acid, phthalic acid, isophthalic acid, terephthalic acid, 1,2,3,-benzenetricarboxylic acid, 1,2,4-benzenetricarboxylic acid, 1,3,5-benzenetricarboxylic acid, and the various isomers of the mono-, di- and tri- naphthoic acids. Again one —COOH of component (B) is employed for each —OH group present within component (A).

As stated earlier, one way of shifting the equilibrium to the right is to employ excess carboxylic acid. After the estolide is formed the excess carboxylic acid can be distilled out or the carboxylic acid can be reacted with a basic compound to form a salt which is then separated out.

Examples of the formation of estolides utilizing aliphatic dicarboxylic acids or aryl mono-, di, or tri-carboxylic acids are as follows.

EXAMPLE A-6

Added to a 2 liter, 4 neck flask are 457 parts lesquerella oil, 58 parts fumaric acid, 4 parts methanesulfonic acid and 250 parts xylene. The lesquerella oil and fumaric acid are charged on a 1 —OH:1 —COOH basis. Mixing is begun at room temperature and it is noted, that the fumaric acid remains insoluble. The contents are heated to effect solution. The temperature is increased to 150° C. and held for 16 hours during which time 9 ml of water is obtained. Solvent is removed first by nitrogen sweeping and finally under vacuum of 25 millimeters mercury. At 70° C. the contents are filtered to give the desired product.

EXAMPLE A-7

Following the procedure of Example A-6,457 parts lesquerella oil, 54.6 parts adipic acid, 5 parts para-toluenesulfonic acid and 400 parts xylene are reacted at 150° C. The contents are stripped and filtered to give the desired product.

EXAMPLE A-8

The procedure of Example A-6 is repeated except that fumaric acid is replaced with maleic acid.

EXAMPLE A-9

Following the procedure of Example A-6, 457 parts lesquerella oil, 94 parts azelaic acid, 8 parts para-toluenesulfonic acid and 500 parts xylene are reacted at 150° C. The contents are stripped and filtered to give the desired product.

EXAMPLE A-10

Following the procedure of Example A-6, 457 parts lesquerella oil, 84 parts phthalic acid, 7 parts para-toluenesulfonic acid and 400 parts xylene are reacted at 150° C. The contents are stripped and filtered to give the desired product.

EXAMPLE A-11

The procedure of Example A-10 is repeated except that phthalic acid is replaced with isophthalic acid.

EXAMPLE A-12

The procedure of Example A-10 is repeated except that phthalic acid is replaced with terephthalic acid.

EXAMPLE A-13

Following the procedure of Example A-6, 457 parts lesquerella oil, 105 parts hemimellitic acid, 10 parts para-toluenesulfonic acid and 500 parts xylene are reacted at 150° C. The contents are stripped and filtered to give the desired product.

EXAMPLE A-14

The procedure of Example A-13 is repeated except that hemimellitic acid is replaced with trimellitic acid.

EXAMPLE A-15

The procedure of Example A-13 is repeated except that hemimellitic acid is replaced with trimesic acid.

(B)(1) The Synthetic Ester Base Oil

The synthetic ester base oil comprises the reaction of a monocarboxylic acid of the formula $$R^3COOH,$$

a dicarboxylic acid of the formula $$\begin{array}{l} R^4-CHCOOH \\ \quad\;\; | \\ \quad (CH_2)_m \\ \quad\;\; | \\ \quad CH_2COOH, \end{array}$$

or an aryl carboxylic acid of the formula $$R^5-Ar(COOH)_p$$

wherein $R^3$ is a hydrocarbyl group containing from about 4 to about 24 carbon atoms, $R^4$ is hydrogen or a hydrocarbyl group containing from about 4 to about 50 carbon atoms, $R^5$ is hydrogen or a hydrocarbyl group containing from 1 up to about 24 carbon atoms, m is an integer of from 0 to about 8, and p is an integer of from 1 to 4; with an alcohol of the formula $$R^6[O(CH_2\overset{\overset{R^7}{|}}{C}HO)_gH]_f$$

wherein $R^6$ is an aliphatic group containing from 1 to about 24 carbon atoms or an aromatic group containing from 6 to about 18 carbon atoms, $R^7$ is hydrogen or an alkyl group containing 1 or 2 carbon atoms, g is from 0 to about 40 and f is from 1 to about 6.

Within the monocarboxylic acid, $R^3$ preferably contains from about 6 to about 18 carbon atoms. An illustrative but non-exhaustive list of monocarboxylic acids are the isomeric carboxylic acids of butanoic, hexanoic, octanoic, nonanoic, decanoic, undecanoic, dodecanoic, palmitic, and stearic acids.

Within the dicarboxylic acid, $R^4$ preferably contains from about 4 to about 24 carbon atoms and m is an integer of from 1 to about 3. An illustrative but non-exhaustive list of dicarboxylic acids are succinic, glutaric, adipic, pimelic, suberic, azelaic, sebacic, maleic, and fumaric acids.

As aryl carboxylic acids, $R^5$ preferably contains from about 6 to about 18 carbon atoms and p is 2. Aryl carboxylic acids having utility are benzoic, toluic, ethylbenzoic, phthalic, isophthalic, terephthalic, hemimellitic, trimellitic, trimeric, and pyromellitic acids.

Within the alcohols, $R^6$ preferably contains from about 3 to about 18 carbon atoms and g is from 0 to about 20. The alcohols may be monohydric, polyhydric or alkoxylated monohydric and polyhydric. Monohydric alcohols can comprise, for example, primary and secondary alcohols. The preferred monohydric alcohols, however are primary aliphatic alcohols, especially aliphatic hydrocarbon alcohols such as alkenols and alkanols. Examples of the preferred monohydric alcohols from which $R^6$ is derived include 1-octanol, 1-decanol, 1-dodecanol, 1-tetradeconal, 1-hexadecanol, 1-octadecanol, oleyl alcohol, linoleyl alcohol, linolenyl alcohol, phytol, myricyl alcohol lauryl alcohol, myristyl alcohol, cetyl alcohol, stearyl alcohol, and behenyl alcohol.

Examples of polyhydric alcohols are those containing from 2 to about 6 hydroxy groups. They are illustrated, for example, by the alkylene glycols such as ethylene glycol, diethylene glycol, triethylene glycol, tetraethylene glycol, dipropylene glycol, tripropylene glycol, dibutylene glycol, tributylene glycol, and other alkylene glycols. A preferred class of alcohols suitable for use in this invention are those polyhydric alcohols containing up to about 12 carbon atoms. This class of alcohols includes glycerol, erythritol, trimethylolpropane (TMP), pentaerythritol, dipentaerythritol, gluconic acid, glyceraldehyde, glucose, arabinose, 1,7-heptanediol, 2,4-heptanediol, 1,2,3-hexanetriol, 1,2,4-hexanetriol, 1,2,5-hexanetriol, 2,3,4-hexanetriol, 1,2,3-butanetriol, 1,2,4-butanetriol, quinic acid, 2,2,6,6-tetrakis (hydroxymethyl) cyclohexanol, 1-10-decanediol, digitaloal, and the like.

Another preferred class of polyhydric alcohols for use in this invention are the polyhydric alcohols containing 3 to 10 carbon atoms and particularly those containing 3 to 6 carbon atoms and having at least three hydroxyl groups. Such alcohols are exemplified by a glycerol, erythritol, pentaerythritol, mannitol, sorbitol, 2-hydroxymethyl-2-methyl-1,3,propanediol (trimethylolpropane), bis-trimethylolpropane, 1,2,4-hexanetriol and the like.

The alkoxylated alcohols may be alkoxylated monohydric alcohols or alkoxylated polyhydric alcohols. The alkoxy alcohols are generally produced by treating an alcohol with an excess of an alkylene oxide such as ethylene oxide or propylene oxide. For example, from about 6 to about 40 moles of ethylene oxide or propylene oxide may be condensed with an aliphatic alcohol.

In one embodiment, the aliphatic alcohol contains from about 14 to about 24 carbon atoms and may be derived from long chain fatty alcohols such as stearyl alcohol or oleyl alcohol.

The alkoxy alcohols useful in the reaction with the carboxylic acids to prepare synthetic esters are available commercially under such trade names as "TRITON®", "TERGITOL®" from Union Carbide, "ALFONIC®" from Vista Chemical, and "NEODOL®" from Shell Chemical Company. The TRITON® materials are identified generally as polyethoxylated alkyl phenols which may be derived from straight chain or branched chain alkyl phenols. The TERGITOLS® are identified as polyethylene glycol ethers of primary or secondary alcohols; the ALFONIC® materials are identified as ethyoxylated linear alcohols which may be represented by the general structure formula $$CH_3(CH_2)_xCH_2(OCH_2CH_2)_nOH$$

wherein x varies between 4 and 16 and n is a number between about 3 and 11. Specific examples of ALFONIC® ethoxylates characterized by the above formula include ALFONIC® 1012–60 wherein x is about 8 to 10 and n is an average of about 5.7; ALFONIC® 1214–70 wherein x is about 10–12 and n is an average of about 10.6; ALFONIC® 1412–60 wherein x is from 10–12 and n is an average of about 7; and ALFONIC® 1218–70 wherein x is about 10–16 and n is an average of about 10.7.

The NEODOL® ethoxylates are ethoxylated alcohols wherein the alcohols are a mixture of linear and branched alcohols containing from 9 to about 15 carbon atoms. The ethoxylates are obtained by reacting the alcohols with an excess of ethylene oxide such as from about 3 to about 12 or more moles of ethylene oxide per mole of alcohol. For example, NEODOL® ethoxylate 23–6.5 is a mixed linear and branched chain alcoholate of 12 to 13 carbon atoms with an average of about 6.5 ethoxy units.

As stated above, the synthetic ester base oil comprises reacting any above-identified acid or mixtures thereof with any above-identified alcohol or mixtures thereof at a ratio of 1 COOH per 1 OH group using esterification procedures, conditions and catalysts known in the art.

A non-exhaustive list of companies that produce synthetic esters and their trade names are BASF as Glissofluid, Ciba-Geigy as Reolube, JCI as Emkarote, Oleofina as Radialube and the Emery Group of Henkel Corporation as Emery.

(B)(2) The Mineral Oil

The mineral oils having utility in this invention comprise liquid petroleum oils, hydrotreated liquid petroleum oils, solvent-treated mineral oils, acid treated mineral oils, naphtha or Stoddard solvent.

The mineral oils are based in particular on hydrocarbon compounds. The mineral oils are unrefined, refined and rerefined oils as well as mixtures of each with the other. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be un unrefined oil.

Refined oils are similar to the unrefined oils except they have been further treated in one or more purification steps to improve one or more properties. Many such purification techniques are known to those skilled in the art such as solvent extraction, secondary distillation, hydrotreating, hydrocracking, acid or base extraction, filtration, percolation, etc.

Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products. Most preferably, the oil used herein is a petroleum derived oil.

(B)(3) The Polyalphaolefin

The polyalphaolefins utilized in this invention are the poly (1-alkenes) wherein the alkene is at least a butene up to about tetracosene. An illustrative but non-exhaustive list includes poly (1-hexenes), poly (1-octenes), poly (1-decenes) and poly (1-dodecenes) and mixtures thereof.

The composition of this invention comprises an admixture of components (A) and (B). Typically the weight ratio of (A):(B) is from (1–99):(99–1), preferably from (10–90):(90–10) and most preferably from (40–60):(60–40).

The below Table I outlines examples of this invention wherein components (A) and (B) are blended together according to the above ranges to effect solution. All parts are by weight.

TABLE I

THICKENING RESULTS OF AN OIL MIXED WITH AN ESTOLIDE

| EXAMPLE | (A) ESTOLIDE | (B) OIL | 40° C. VISCOSITY | 100° C. VISCOSITY | VISCOSITY INDEX |
|---|---|---|---|---|---|
| 1 | 100 parts Product of Example A-2 | None | 85.28Cst | 15.0 Cst | 186 |
| 2 | None | 100 parts Glissofluid[1] | 10.91 | 3.05 | 144 |
| 3 | 90 parts Product of Example A-2 | 10 parts Glissofluid | 70.11 | 13.05 | 190 |
| 4 | 70 parts Product of Example A-2 | 30 parts Glissofluid | 46.52 | 9.54 | 195 |
| 5 | 50 parts Product of Example A-2 | 50 parts Glissofluid | 30.94 | 6.98 | 198 |

[1]a dioctyl adipate ester available from BASF

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A composition, comprising;

(A) at least one triglyceride estolide of the formula

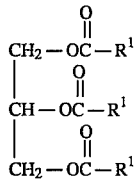

wherein one of the $R^1$ group is an aliphatic group containing from 10 to 20 carbon atoms and the remaining $R^1$ groups are

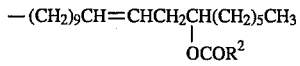

and $R^2$ is a aliphatic group containing from 2 to 24 carbon atoms and (B) at least one oil comprising (1) synthetic ester base oil comprising the reaction of a monocarboxylic acid of the formula $R^3COOH$, or a dicarboxylic acid of the formula

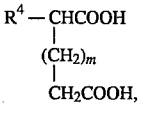

or an aryl carboxylic acid of the formula $R^5—Ar(COOH)_p$ wherein $R^3$ is a hydrocarbyl group containing from about 4 to about 24 carbon atoms, $R^4$ is hydrogen or a hydrocarbyl group containing from about 4 to about 50 carbon atoms, $R^5$ is hydrogen or a hydrocarbyl group containing from 1 up to about 24 carbon atoms, m is an integer of from 0 to about 8, and p is an integer of from 1 to 4; with an alcohol of the formula

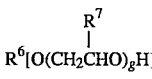

wherein $R^6$ is an aliphatic group containing from 1 to about 24 carbon atoms or an aromatic group containing from 6 to about 18 carbon atoms, $R^7$ is hydrogen or an alkyl group containing 1 or 2 carbon atoms, g is from 0 to about 40 and f is from 1 to about 6;

(2) a mineral oil; or (3) a polyalphaolefin.

2. The composition of claim 1 wherein $R^1$ is

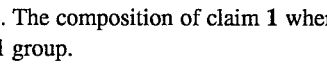

$R^2$ is an aliphatic group containing from 4 to 13 carbon atoms and n is from 5 to 13.

3. The composition of claim 1 wherein $R^3$ is an aliphatic group containing from about 6 to about 18 carbon atoms.

4. The composition of claim 1 wherein $R^4$ contains from about 4 to about 24 carbon atoms and m is zero.

5. The composition of claim 1 wherein $R^4$ is hydrogen and m is from 0 to 6.

6. The composition of claim 1 wherein $R^5$ is an aliphatic group containing from about 3 to about 18 carbon atoms and p is 2.

7. The composition of claim 1 wherein $R^5$ contains from about 6 to about 18 carbon atoms and p is 2.

8. The composition of claim 1 wherein $R^6$ contains from 3 to about 18 carbon atoms, g is zero and f is 4.

9. The composition of claim 8 wherein the alcohol is

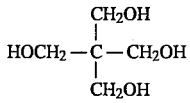

10. The composition of claim 8 wherein the alcohol is

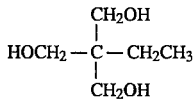

11. The composition of claim 1 wherein the mineral oil comprises liquid petroleum oils, hydrotreated liquid petroleum oils, solvent-treated mineral oils, acid treated mineral oils, naphtha or Stoddard solvent.

12. The composition of claim 1 wherein $R^2$ is a heptadecenyl group.

13. The composition of claim 1 wherein $R^2$ is an isostearyl group.

14. A composition, comprising;

(A) at least one triglyceride estolide prepared by reacting a triglyceride containing —OH functionality with a carboxylic acid of the formula $R^2COOH$, $HOOCCH{=}CHCOOH$, $HOOC(CH_2)_tCOOH$, or $Ar(COOH)_x$ or esters thereof wherein $R^2$ is a aliphatic group containing from 2 to 24 carbon atoms, t is from zero up to 8, Ar is a benzene or naphthalene nucleus and x is 1, and (B)(1) at least one synthetic ester base oil comprising the reaction of a monocarboxylic acid of the formula $R^3COOH$, or a dicarboxylic acid of the formula

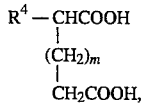

or an aryl carboxylic acid of the formula

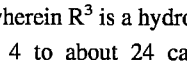

wherein $R^3$ is a hydrocarbyl group containing from about 4 to about 24 carbon atoms, $R^4$ is hydrogen or a hydrocarbyl group containing from about 4 to about 50 carbon atoms, $R^5$ is hydrogen or a hydrocarbyl group containing from 1 up to about 24 carbon atoms, m is an integer of from 0 to about 8, and p is an integer of from 1 to 4; with an alcohol or the formula

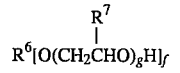

wherein $R^6$ is an aliphatic group containing from 1 to about 24 carbon atoms or an aromatic group containing from 6 to about 18 carbon atoms, $R^7$ is hydrogen or an alkyl group containing 1 or 2 carbon atoms, g is from 0 to about 40 and f is from 1 to about 6.

15. The composition of claim 14 wherein Ar is a benzene nucleus and x is 1.

16. The composition of claim 14 wherein HOOCCH=CHCOOH is fumaric acid.

17. The composition of claim 14 wherein t is 4.

18. The composition of claim 14 wherein m is from 1 to about 3.

* * * * *